US009415617B2

(12) United States Patent
Sasa

(10) Patent No.: US 9,415,617 B2
(45) Date of Patent: Aug. 16, 2016

(54) IMAGE FORMING APPARATUS, CONTROL METHOD OF IMAGE FORMING APPARATUS, AND NON-TRANSITORY RECORDING MEDIUM

(71) Applicant: Tomohiro Sasa, Kanagawa (JP)

(72) Inventor: Tomohiro Sasa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/919,371

(22) Filed: Oct. 21, 2015

(65) Prior Publication Data

US 2016/0129714 A1 May 12, 2016

(30) Foreign Application Priority Data

Nov. 10, 2014 (JP) ..... 2014-228243
Aug. 5, 2015 (JP) ..... 2015-155430

(51) Int. Cl.
*B41J 29/393* (2006.01)

(52) U.S. Cl.
CPC ..... *B41J 29/393* (2013.01)

(58) Field of Classification Search
CPC .... B41J 25/001; B41J 19/202; B41J 25/3086; B41J 2/01; B41J 11/008; B41J 11/0095; B41J 19/145
See application file for complete search history.

(56) References Cited

U.S. PATENT DOCUMENTS 7,503,637 B2 * 3/2009 Komatsu ..... B41J 2/16579 347/19
8,414,101 B2 * 4/2013 Anzai ..... B41J 19/202 347/19
8,807,682 B2 * 8/2014 Hagiwara ..... B41J 2/15 347/14

FOREIGN PATENT DOCUMENTS

JP 2-281948 11/1990
JP 5-024317 2/1993
JP 2004-122681 4/2004
JP 2009-078511 4/2009

* cited by examiner

*Primary Examiner* — Lamson Nguyen
(74) *Attorney, Agent, or Firm* — Harness, Dickey & Pierce, P.L.C.

(57) ABSTRACT

An image forming apparatus includes a recording head to discharge ink to a recording medium to form an image thereon, an optical sensor to output a signal in response to intensity of reflection of light emitted to the direction of discharging the ink, a carriage that carries the recording head and the optical sensor, and a control unit to detect the position of the recording medium based on the signal output by the optical sensor and control the recording head to discharge the ink only onto the position of the recording medium, wherein the control unit acquires a value according to the signal output by the optical sensor in response to the movement of the carriage and detects the position of the recording medium when a predetermined relation between the value and a threshold continues at least for a predetermined interval in the movement of the carriage.

7 Claims, 11 Drawing Sheets

| MAIN SCANNING POSITION | SHEET SENSOR OUTPUT |
|---|---|
| $X_{001}$ | $S_{001}$ |
| $X_{002}$ | $S_{002}$ |
| $X_{003}$ | $S_{003}$ |
| $X_{004}$ | $S_{004}$ |
| $X_{005}$ | $S_{005}$ |
| . . . | |

START POSITION OF SHEET : $X_{start}$

END POSITION OF SHEET : $X_{end}$

| | DETECTION POSITION | C | M | Y | K |
|---|---|---|---|---|---|
| START POSITION OF SHEET | $X_{start}$ | $X_{start-C}$ | $X_{start-M}$ | $X_{start-Y}$ | $X_{start-K}$ |
| END POSITION OF SHEET | $X_{end}$ | $X_{end-C}$ | $X_{end-M}$ | $X_{end-Y}$ | $X_{end-K}$ |

| |
|---|
| DISCHARGEABLE RANGE 1 : $X_a$ , $X_b$ |
| DISCHARGEABLE RANGE 2 : $X_c$ , $X_d$ |
| DISCHARGEABLE RANGE 3 : $X_e$ , $X_f$ |
| . . . |

IMAGE FORMING APPARATUS, CONTROL METHOD OF IMAGE FORMING APPARATUS, AND NON-TRANSITORY RECORDING MEDIUM

CROSS-REFERENCE TO RELATED APPLICATIONS

This patent application is based on and claims priority pursuant to 35 U.S.C. §119 to Japanese Patent Application Nos. 2014-228243 and 2015-155430, on Nov. 10, 2014 and Aug. 5, 2015 respectively, in the Japan Patent Office, the entire disclosures of which are hereby incorporated by reference herein.

BACKGROUND

1. Technical Field

The present invention relates to an image forming apparatuses, a control method of image forming apparatus, and a non-transitory recording medium.

2. Background Art

With advances of digitization of information, image forming apparatuses have become indispensable. For example, machines such as printers and facsimile machines are used to output digitized information and devices such as scanners to digitize documents. Many of these image forming apparatuses acquire capabilities of taking images, image forming, communications, etc. and serve as multifunction peripherals of printers, facsimile machines, scanners, and photocopiers.

Of these image forming apparatuses, there are printers employing inkjet methods (hereinafter referred to as inkjet printers) as one embodiment for use in output of digitized information. Inkjet printers include recording heads having nozzles to discharge ink and conduct image forming by discharging the ink onto a recording medium by applying a pressure to liquid chambers of the ink in the recording heads.

In such an inkjet printer, sheets (recording medium) are transferred on a portion (hereinafter referred to as facing member) facing the recording head to discharge the ink and the ink is discharged from the recording head to the sheets in transfer. In addition, the recording head discharges the ink all over a sheet while moving in the perpendicular direction (hereinafter referred to as main scanning direction) to the direction of transferring the sheets (hereinafter referred to as sub-scanning direction).

SUMMARY

According to the present invention, provides is an improved image forming apparatus that includes a recording head to discharge ink to a recording medium to form an image thereon, an optical sensor to output a signal in response to intensity of reflection of light emitted to the direction of discharging the ink, a carriage that carries the recording head and the optical sensor, and a control unit to detect the position of the recording medium within the range of movement of the carriage based on the signal output by the optical sensor and control the recording head to discharge the ink only onto the position of the recording medium, wherein the control unit acquires a value according to the signal output by the optical sensor in response to the movement of the carriage and detects the position of the recording medium within the range of movement of the carriage when a predetermined relation between the value and a threshold continues at least for a predetermined interval in the movement of the carriage.

BRIEF DESCRIPTION OF THE SEVERAL VIEWS OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
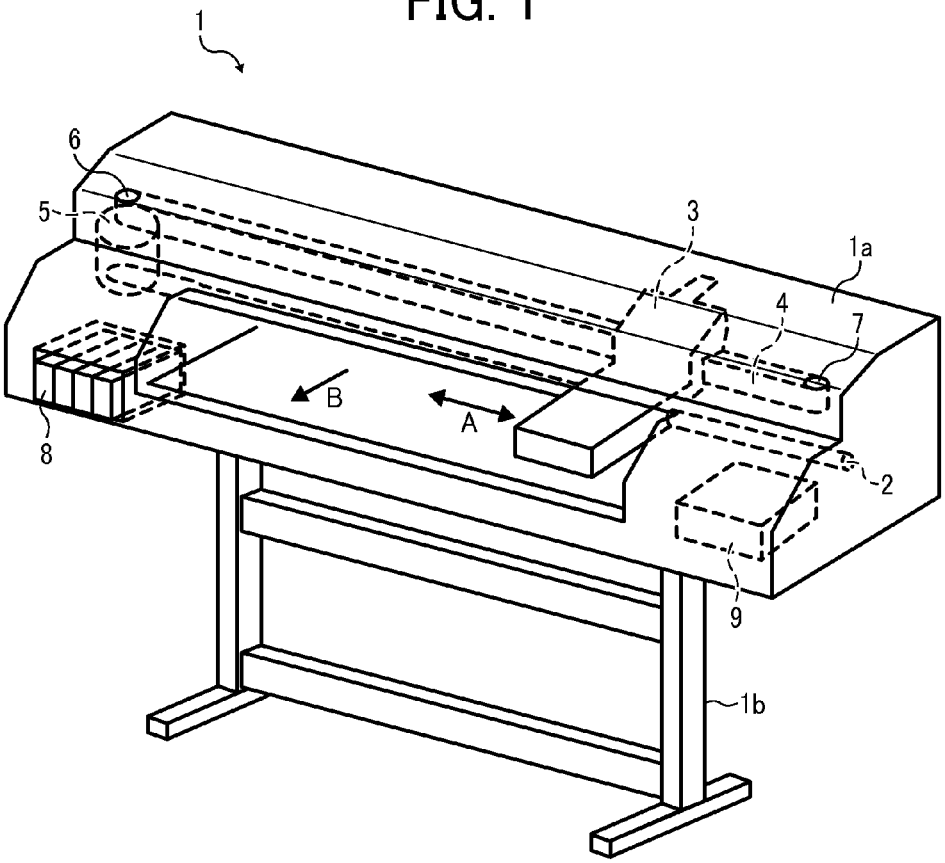
FIG. 1 is a perspective diagram illustrating an overview of the image forming apparatus according to an embodiment of the present disclosure.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

In the following description, illustrative embodiments will be described with reference to acts and symbolic representations of operations (e.g., in the form of flowcharts) that may be implemented as program modules or functional processes including routines, programs, objects, components, data structures, etc., that perform particular tasks or implement particular abstract data types and may be implemented using existing hardware at existing network elements or control nodes. Such existing hardware may include one or more Central Processing Units (CPUs), digital signal processors (DSPs), application-specific-integrated-circuits, field programmable gate arrays (FPGAs) computers or the like. These terms in general may be referred to as processors.

Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

Preferred embodiments of the present invention are described in detail below with reference to the accompanying drawings. Although the presently preferred embodiments of the present invention are described with various technically preferred limitations, the scope of the invention should not be construed as limited by the embodiments discussed below. It should not be construed that all of elements of the embodiments discussed below are essential to the invention unless specifically stated as such.

First Embodiment

Embodiments of the present disclosure are described with reference to the accompanying drawings. This embodiment is an image forming apparatus employing an inkjet method, which is described using a broad width type apparatus that conducts image forming output for large-sized recording media as an example. Such an apparatus executes detection processing to determine whether there is a recording medium by a sensor provided to a carriage.

FIG. 1 is a perspective view of an overview illustrating an image forming apparatus 1 according to an embodiment of the present disclosure. The image forming apparatus 1 of this embodiment is a serial type inkjet recording device and includes a recording device 1*a* and a frame 1*b* to support the recording device 1*a* as illustrated in FIG. 1. A guide rod 2 is provided inside the recording device 1*a*. A carriage 3 is held by the guide rod 2 in such a manner that the carriage 3 is movable in the direction indicated by an arrow A in FIG. 1. This direction indicated by the arrow A represents the main-scanning direction.

The carriage 3 is fixed onto part of a timing belt 4 and reciprocates in the main-scanning direction by driving the timing belt 4 by a main scanning motor 5 and a drive pully 6. A tension is applied to the timing belt 4 by a pressure roller 7 to be able to drive the carriage 3 and the timing belt 4 is driven without sagging.

The sheet serving as a recording medium is intermittently transferred to a direction indicated by an arrow B in FIG. 1 (i.e., the direction perpendicular to the main-scanning direction and parallel to the surface of the recording medium) just below the range in which the carriage 3 reciprocates. This direction indicated by the arrow B represents the sub-scanning direction. Images are formed on the recording medium with ink discharged from a recording head carried on the carriage 3.

In addition, the recording device 1*a* includes a cartridge 8 to supply ink to the recording head and a maintenance mechanism 9 to clean the recording head. The carriage 3 includes an encoder inside. The control unit to control the movement of the carriage 3 drives the carriage 3 while detecting the position in the main scanning direction of the carriage 3 by referring to continuous results of reading of an encoder sheet stretched in the main scanning direction.

Figure 2:
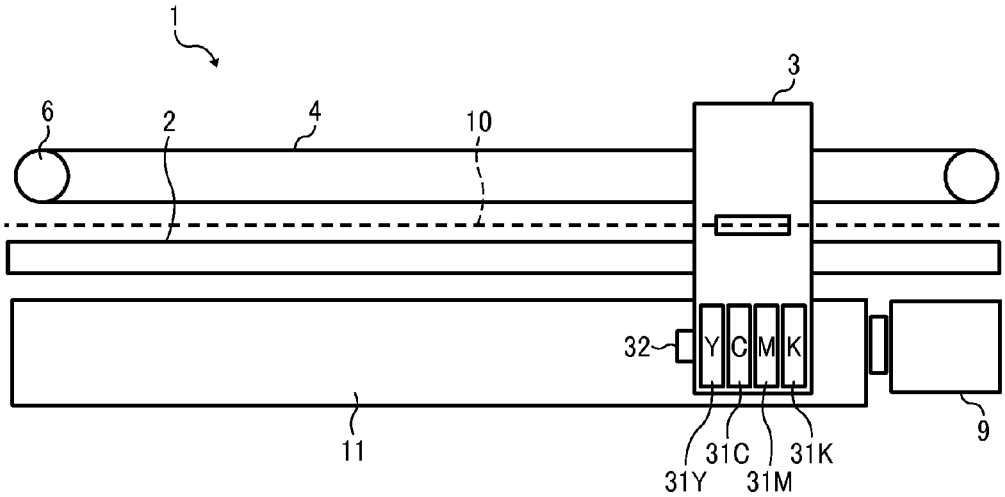
FIG. 2 is a diagram illustrating an image forming mechanism in the image forming apparatus according to an embodiment of the present disclosure.

FIG. 2 is a diagram illustrating the image forming mechanism in the recording device 1*a*. As illustrated in FIG. 2, in the recording device 1*a*, the guide rod 2 is bridged between the left plate and the right plate and supports the carriage 3 at its bearing portion in such a manner that the carriage 3 is movable in the carriage scanning direction.

The carriage 3 carries recording heads 31C, 31M, 31Y, and 31K (hereinafter, the four heads are referred to as just the recording head 31) to discharge ink droplets. In addition, the carriage 3 carries a sheet sensor 32. The main scanning mechanism to drive and scan the carriage 3 include the main scanning motor 5, the drive pully 6, the pressure roller 7, and the timing belt 4 described in the description of FIG. 1.

The encoder sheet 10 is arranged along the main scanning direction of the carriage 3. The main scanning position of the carriage 3 is detected by reading the encoder sheet 10 by an encoder sensor 33 carried on the carriage 3. A facing member 11 is arranged just below the range of movement of the carriage 3 in the main scanning direction. The recording medium is transferred on the facing member 11.

Figure 3:
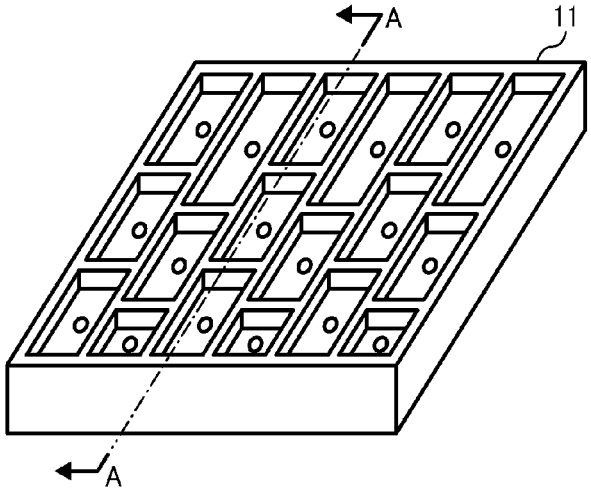
FIG. 3 is a perspective view of an overview of a facing member according to an embodiment of the present disclosure.
Figure 4:
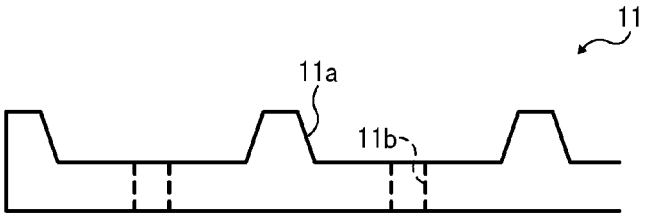
FIG. 4 is a cross section of the facing member according t an embodiment of the present disclosure.

FIG. 3 is a diagram illustrating an overview of the facing member according to this embodiment of the present disclosure. In addition, FIG. 4 is a cross section relative to a cutting line A illustrated in FIG. 3. As illustrated in FIGS. 3 and 4, a concave portion 11*a* and an inlet 11*b* are provided to the facing member 11. The sheet to be transferred on the facing member 11 is drawn to the facing member 11 by suction from the inlet 11*b*, thereby to prevent the sheet from floating from the facing member 11.

Figure 5:
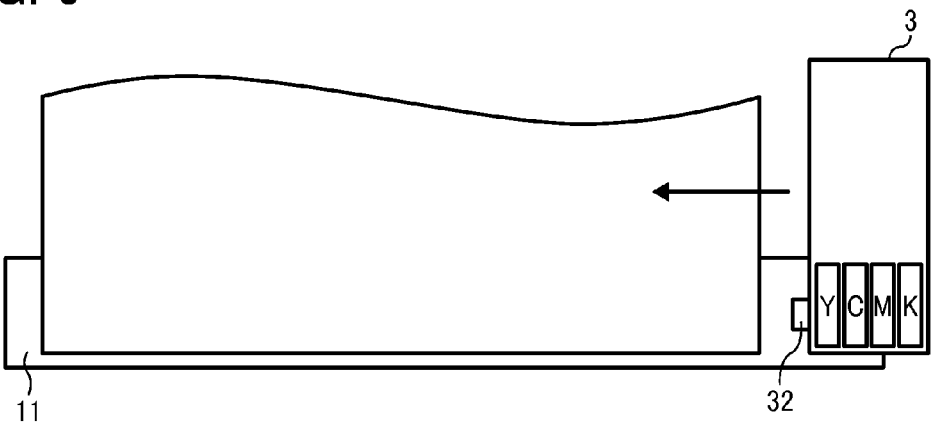
FIG. 5 is a block diagram illustrating the configuration of an image forming apparatus according to an embodiment of the present disclosure.

FIG. 5 is a diagram illustrating the state of movement of the carriage 3 according to this embodiment of the present disclosure. As illustrated in FIG. 5, in the recording device 1*a* according to the embodiment, image forming output is conducted by discharging ink from the recording head 31 while the carriage 3 is moving in the direction indicated by the arrow in FIG. 5.

As illustrated in FIG. 5, a sheet sensor 32 is arranged on the front side (head) when the carriage 3 moves while discharging ink, that is, at a position downstream of the carriage 3 in the direction of movement of the carriage 3. Accordingly, when the carriage 3 moves while discharging ink from the recording head 31, the nozzles of the recording head 31 reach the position of discharging after the sheet is detected by the sheet sensor 32.

Figure 6:
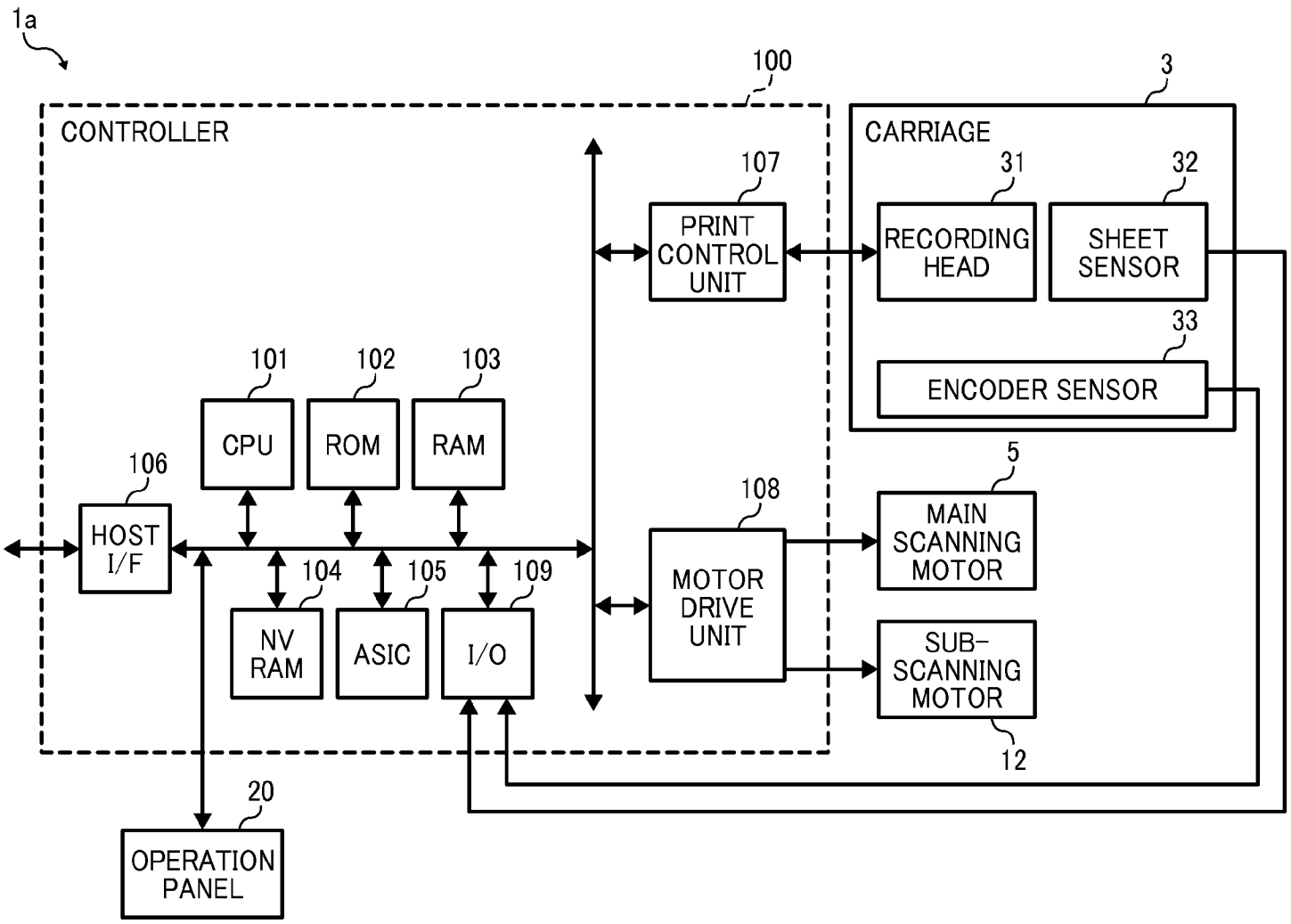
FIG. 6 is a block diagram illustrating the feature of a sheet sensor according to an embodiment of the present disclosure.

Next, the feature configurations of the recording device 1*a* according to the embodiment are described. As illustrated in FIG. 6, the recording device 1*a* of this embodiment includes a controller 100, an operation panel 20, and a sub-scanning motor 12 in addition to the carriage 3 and the main scanning motor 5 described above.

The operation panel 20 is an interface serving as an operation unit and a display unit to input and display information required for the image forming apparatus 1. The sub-scanning motor 12 rotates a roller to transfer sheets on which images are output.

The controller 100 is a control unit to control the operations of the image forming apparatus 1. As illustrated in FIG. 6, the controller 100 includes a central processing unit (CPU) 101, a read only memory (RAM) 102, a random access memory (RAM) 103, a non-volatile RAM (NVRAM) 104, an application specific integrated circuit (ASIC) 105, a host I/F 106, a print control unit 107, a motor drive 108, and an I/O 109.

The CPU 101 is a computing device to control operations of each part of the controller 100. The ROM 102 is a non-volatile storage medium for read-only to store programs such as firmware. The RAM 103 is a high-performance volatile recording medium capable of reading and writing information and is used as the working area when the CPU 101 processes information. The NVRAM 104 is a non-volatile recording medium capable of reading and writing information and stores control programs and parameters for control.

The ASC 105 is a hardware circuit to execute image processing required for image forming output. The host I/F 106 is an interface to receive information from a higher-rank device. Ethernet™ and universal serial bus (USB) interface are used. The I/O 109 is a port to input signals from various sensors such as the sheet sensor 32 and the encode sensor 33 into the controller 100.

The print control unit 107 includes a data transfer device to drive and control the recording head 31 carried on the carriage 3 and a drive waveform generating device to generate a drive waveform. The motor drive 108 drives the main scanning motor 5 and the sub-scanning motor 12.

As described above, the image data to be output are input into the host I/F 106 in the controller 100 and stored in the reception buffer in the host I/F 106. The CPU 101 computes according to the program in the ROM 102 and the program loaded into the RAM 103 and executes various features. Specifically, the CPU 101 reads and analyzes image data in the reception buffer in the host I/F 106 and executes image processing, data sorting processing, etc. by controlling the ASIC 105. Thereafter, the CPU 101 controls the print control unit 107 to transmit the image data processed at the ASIC 105 to the recording head 31 on the carriage 3.

In addition to transfer of serial data of the image data to the recording head 31, the print control unit 107 outputs transfer clocks, latch signals, droplet control signals, mask signals, etc. required to transfer the image data and determine the transfer. The print control unit 107 also includes a drive waveform generating unit having a D/A converter to conduct D/A conversion of the pattern data of the drive signal stored in the ROM 102, a voltage amplifier, a current amplifier, etc. The print control unit 107 generates a drive waveform and outputs it to the recording head 31.

The recording head 31 includes a head driver to control discharging of ink as well as the mechanism to discharge the ink as described above. The head driver drives the recording head 31 by selectively applying a drive signal constituting the drive waveform provided from the print control unit 107 to a drive element that generates energy to discharge droplets from the recording head 31 based on drawing data corresponding to the amount of a single line input in a serial manner.

In addition, the CPU 101 calculates a speed determination value and a position determination value obtained by sampling detection pulses from the encoder sensor 33 provided to the carriage 3 and a drive output value (control value) for the main scanning motor 5 based on the speed target value and the position target value obtained from the speed and position profile stored in advance to drive the main scanning motor 5 via the motor driving unit 108. In addition, the CPU 101 controls the motor drive unit 108 to drive the sub-scanning motor 12 in response to the movement of the carriage 3 caused by the drive of the main scanning motor 5.

Figure 7:
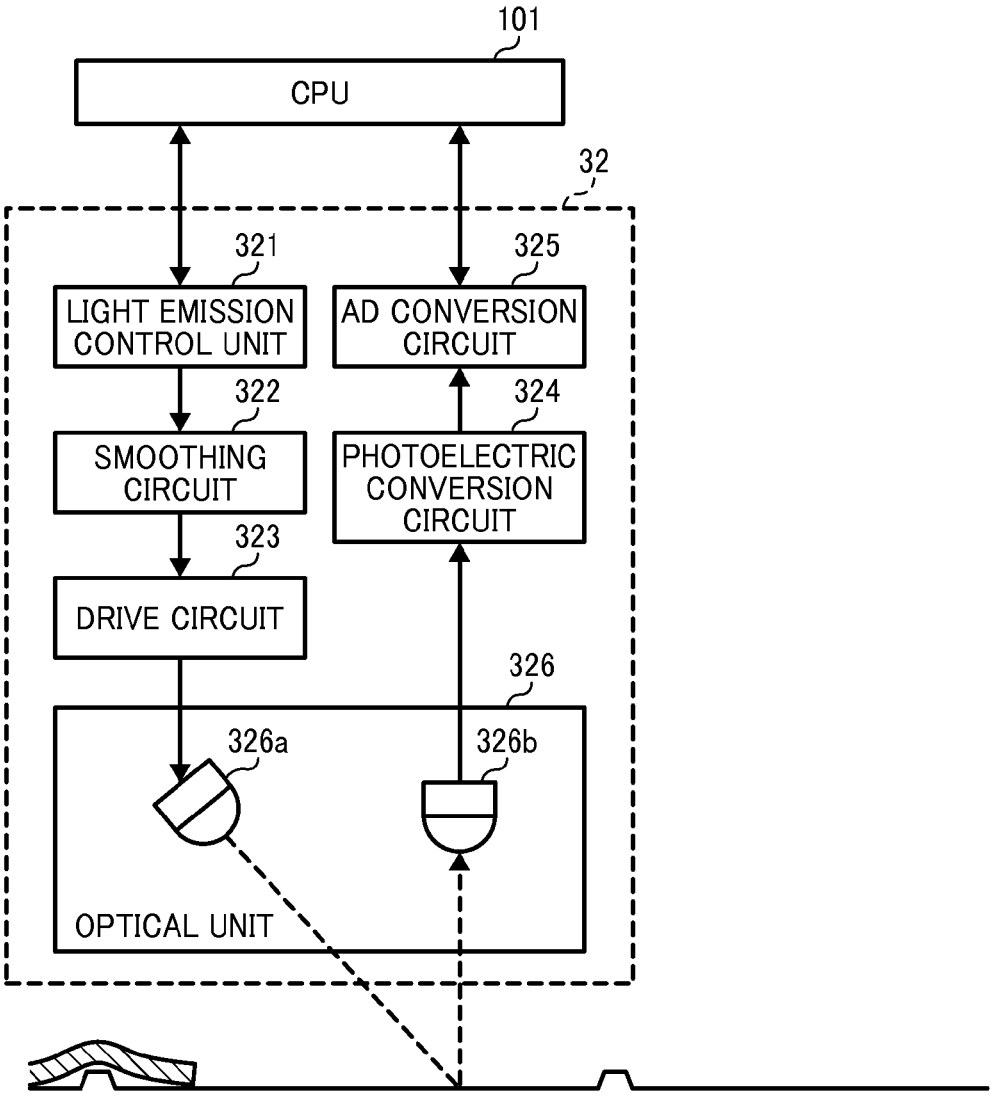
FIG. 7 is a diagram illustrating the state of the movement of a carriage when a recording head discharges ink according to an embodiment of the present disclosure.

Next, the configuration of the sheet sensor 32 is described with reference to FIG. 7. FIG. 7 is a block diagram illustrating the feature configuration of the sheet sensor 32. As illustrated in FIG. 7, the sheet sensor 32 is an optical sensor that includes an optical unit 326 having a package holding a light emitting element 326*a* serving as a light emitting device and a light receiving element 326*b* as a light receiving device to receive reflection from the facing member of a sheet in a holder.

Lenses are provided to light emitting portion and light receiving portion of the holder of the optical unit 326. The light emitting element 326*a* and the light receiving element 326*b* are arranged perpendicular to the scanning direction of the carriage 3 in the sheet sensor 326. This configuration makes it possible to reduce an impact caused by the fluctuation of the speed of the movement of the carriage 3 on the detection result. In addition, the light emitting element 326*a* may use relatively simple and inexpensive light source such as visible light by LED.

The spot diameter of the light emitting element 326*a* is the detection range and the detection area. In this embodiment, no high-precision lens is required because the tolerance of detection of the size of a sheet is not relatively strict, for example, the magnitude of mm. The sheet sensor 32 detects and controls the size of a sheet by reading the facing member 11 or the sheet while moving the carriage 3 in the main scanning direction.

Specifically, the CPU 101 sets a pulse width modulation (PWM) value for a light emitting control unit (controller) 321 via the I/O 109 to drive the light emitting element 326*a*. A drive circuit 323 conducts light-emission drive of the light emitting element 326*a* by providing the output of this light emitting control unit 321 to the drive circuit 323 via a smoothing circuit 323. Then, the light emitting element 326*a* irradiates the facing member 11 or the sheet with irradiation light.

Reflection of the light emitted to the facing member 11 or the sheet is received at the light reception element 326*b*. The output signal from the light reception element 326*b* is optically converted at a photoelectric conversion circuit 324. An A/D conversion circuit 325 digitizes this photoelectric conversion signal. The CPU 101 acquires the digital value converted this way via the I/O 109.

The CPU 101 stores the read result of the digital value acquired this way in a memory, determines the size of the sheet based on the results of reading acquired at each position along the main scanning direction, and controls ink discharging according to the determination result. That is, the CPU 101 serves as a control unit.

Although various circuits are included in the sheet sensor 32 in FIG. 7, it is possible to have a configuration such that the controller 100 includes part or the entire of the circuits other than the optical unit 326.

Figure 8:
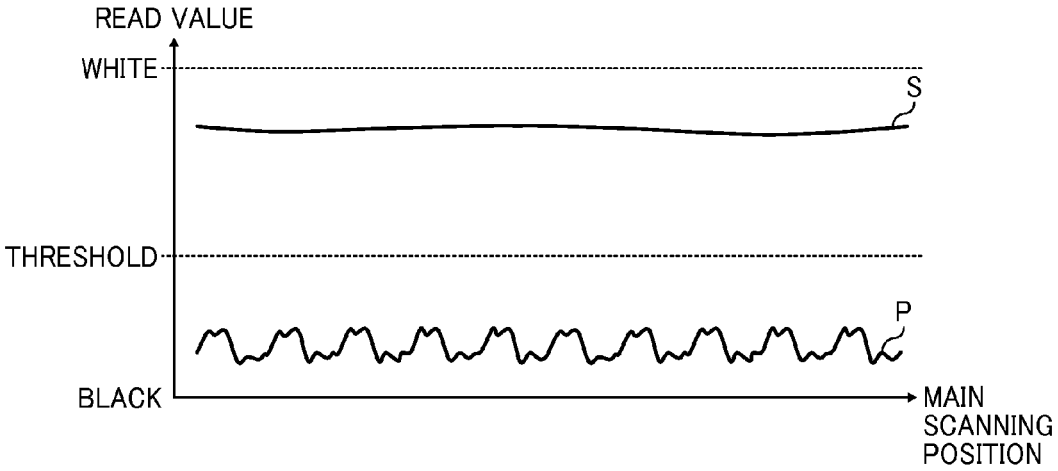
FIG. 8 is a diagram illustrating an example of the sheet detection result of plain paper according to an embodiment of the present disclosure.

Below are examples of the results of reading according to the positions along the main scanning direction. FIG. 8 is a diagram illustrating the results of reading of a sheet and the facing member 11 according to the main scanning position. In FIG. 8, S and P respectively represent the results of reading of plain paper and the results of reading of the facing member. The detection signal of the light reception element 326*b* is strong as the color of the target to be read is closer to white and becomes the maximum for white and zero for black as illustrated in FIG. 8.

In the case of plain paper, since the color is close to white, the result of reading is a value closer to that for white. However, the reflection rate of a sheet has minor fluctuation depending on the position in the sheet so that the results of reading according to the main scanning position do not form a perfect straight line as illustrated in FIG. 8. On the other hand, the facing member 11 has colors of relatively low reflection rates. Therefore, the results of reading are low values as illustrated in FIG. 8. As illustrated in FIGS. 3 and 4, since the facing member 11 in this embodiment has a rough surface so that the results of reading according to the main scanning position vary reflecting the rough surface.

As described above, the reflection rate of the portion where a sheet is placed on the facing member 11 is high so that the signal intensity is strong while the reflection rate of the portion where the facing member 11 is not covered with the sheet is low so that the signal intensity is weak. Accordingly, as illustrated in FIG. 8, by setting a threshold, it is possible to detect whether or not there is a sheet based on whether the signal intensity is higher or lower than the threshold so that both ends of the sheet along the main scanning direction can be detected.

Figure 9:
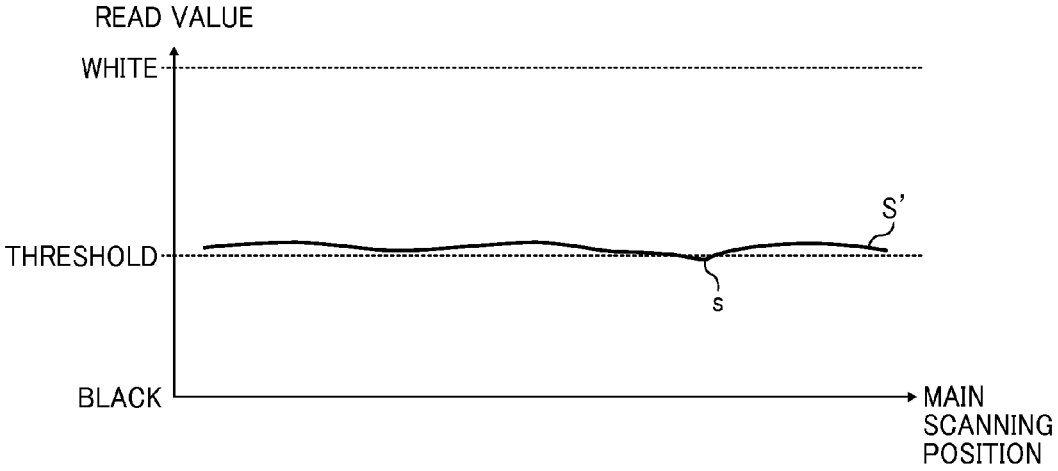
FIG. 9 is a diagram illustrating an example of the sheet detection result of tracing paper according to an embodiment of the present disclosure.

FIG. 9 is a diagram illustrating the results of reading of a sheet according to the main scanning position, which makes a target of this embodiment. FIG. 9 is graphs illustrating cases in which the results of reading by the sheet sensor 32 indicate weak signal intensity, for example, a sheet such as tracing paper through which the color of the facing member 11 is seen and a sheet having a low reflection rate ascribable to its original dark color.

As illustrated in FIG. 9, when the sheet sensor 32 reads a sheet having a weak signal intensity as the results of reading, the difference between the signal intensity and the threshold decreases. Depending on the variability of the signal intensity, the signal intensity may become under the threshold as illustrated as s in FIG. 9. In such a case, it is determined as no sheet present although there is a sheet in fact. This problem is solved by the way of detection of the size of a sheet according to this embodiment.

Figure 10:
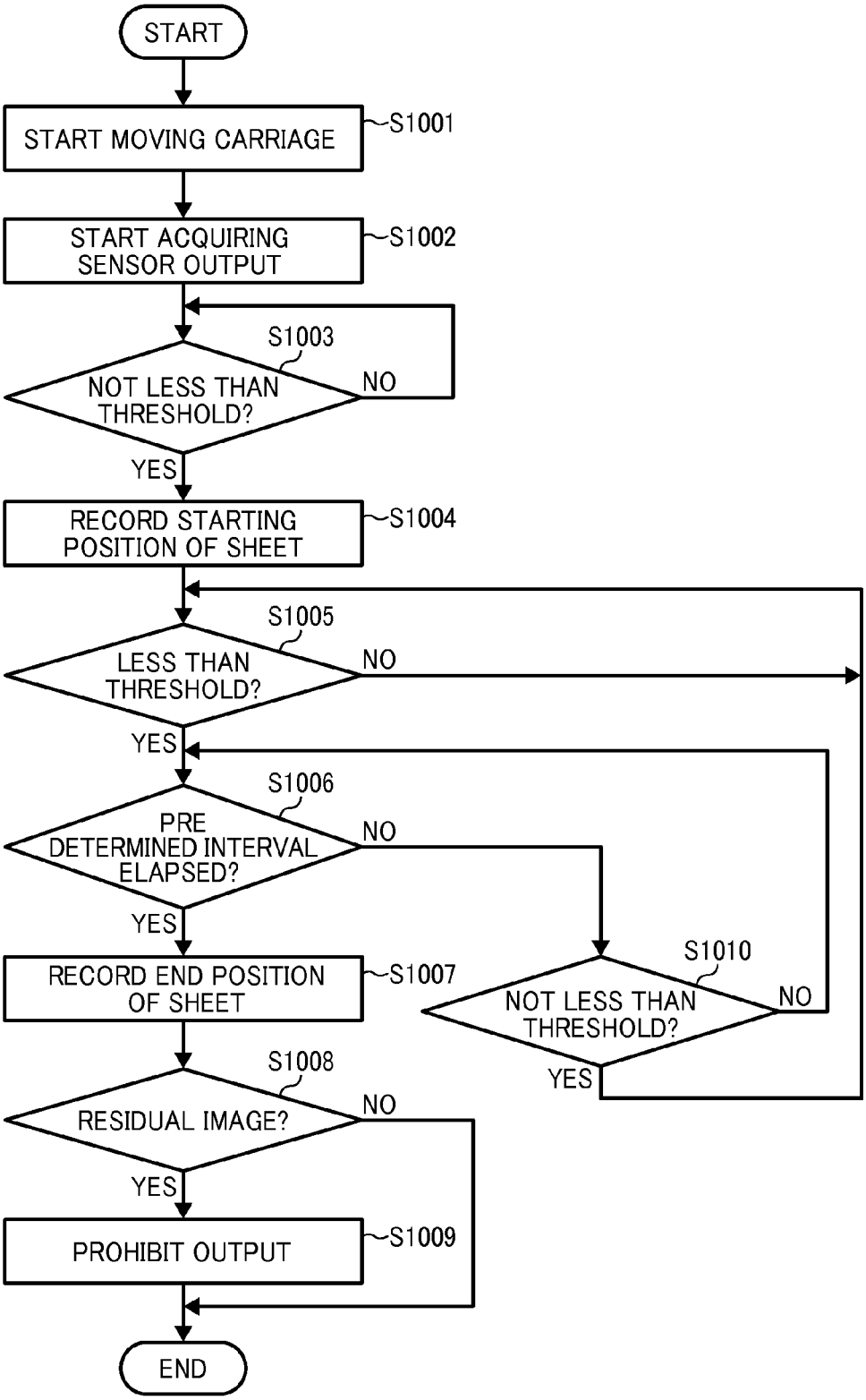
FIG. 10 is a flow chart illustrating operations of sheet detection of the image forming apparatus according to an embodiment of the present disclosure.

FIG. 10 is a flow chart illustrating the processing by the CPU 101 in the sheet detection of the embodiment. The sheet detection of the embodiment is conducted at the first line of the operation of the movement of the carriage 3 in the main scanning direction for image forming output. As illustrated in FIG. 10, the CPU 101 starts movement control of the carriage 3 while discharging ink from the recording head 31 at image forming output (S1001). At the same time, the CPU 101 commences acquiring the detection signal output of the sheet sensor 32 (S1002).

The CPU 101 recognizes the position of the movement of the carriage 3 based on the output of the encoder sensor 33. Accordingly, by commencing acquisition of the detection signal of the sheet sensor 32 in the step of S1002, the CPU 101 becomes capable of storing the detection signal of the sheet sensor 32 correlating with the main scanning position of the carriage 3 as illustrated in FIG. 11.

Figures 11, 12, 13A, 13B:
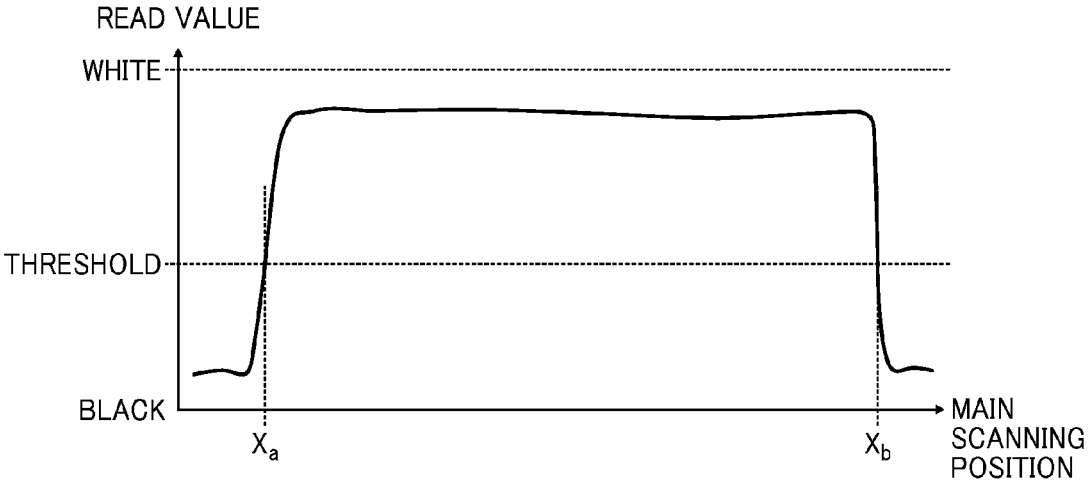
FIG. 11 is a diagram illustrating information created in the process of sheet detection according to an embodiment of the present disclosure.
FIG. 12 is a diagram illustrating an example of the sheet detection result of plain paper according to an embodiment of the present disclosure.
FIGS. 13A and 13B are diagrams illustrating information created in the operation of sheet detection according to an embodiment of the present disclosure.

The CPU 101 compares the result of reading by the sheet sensor 32 depending on the main scanning position with the threshold as illustrated in FIG. 11 and determines whether the threshold reaches or surpasses (i.e., is not less than) the result of reading (S1003). Taking into account the arranged position of the sheet illustrated in FIG. 5, the detection position of the sheet sensor 32 is still on the facing member 11 immediately after the carriage 3 starts moving from the home position. Accordingly, the result of the reading is less than the threshold, so that the CPU 101 repeats comparison with the threshold (S1003/NO).

Thereafter, the carriage 3 moves as indicated by the arrow illustrated in FIG. 5 and the detection position of the sheet sensor 32 reaches the position over the sheet, the signal intensity as the result of reading reaches or surpasses the threshold (S1003/YES). Then, the CPU 101 records the main scanning position of the carriage 3 at the time, that is, the position determined based on the value read by the encoder sensor 33, as the start position of the main scanning direction of the sheet, that is, one end of the main scanning direction (S1004). What is recorded is based on the value read by the encoder sensor 33, which represents the reading position of the sheet sensor 32. The CPU 101 determines the range of image forming by referring the end of the main scanning direction recorded in the step S1004 as the reference.

The CPU 101 repeats executing the comparison processing of the results of reading by the sheet sensor 32 with the threshold after the steps of S1004 (S1005). When the signal intensity is not less than the threshold (S1005/NO), the CPU 101 determines that the carriage 3 is moving over the sheet and repeats the processing.

As the carriage 3 continues moving along the main scanning direction, the carriage 3 passes over the range of the sheet in the main scanning direction. Therefore, the detection position of the sheet sensor 32 moves from the sheet to the facing member 11. As a result, the result of reading by the sheet sensor 32 becomes less than the threshold (S1005/YES).

FIG. 12 is a graph illustrating the results of reading according to the main scanning position in such a case. The position of the carriage 3 on the timing of YES in the step of S1003 is $X_a$ illustrated in FIG. 12. In addition, the position of the carriage 3 on the timing of YES in the step of S1005 is $X_b$ illustrated in FIG. 12.

The CPU 101 determines whether a relation in which the result of reading is below the threshold continues for a predetermined interval (period) on YES in the step of S1005 (S1006).

This predetermined interval is described later in detail. The processing in the step of S1006 is one of what the embodiment is for.

As a result of the determination in the step of S1006, if the relation in which the result of reading is below the threshold continues for a predetermined interval (S1006/YES), the CPU 101 records the position of the carriage 3 on the timing of "YES" in the step of S1005 (S1007). The value recorded in the step of S1007 represents the end position of the sheet in the main scanning direction, that is, the other end in the main scanning direction.

By these processing, as illustrated in FIG. 13A, the start position and the end position of the sheet in the main scanning direction are recorded. The information illustrated in FIG. 13A is held on, for example, the RAM 103.

The CPU 101 determines the position of the sheet based on the generated start position and end position in the main scanning direction and controls the recording head 31 in order to discharge the ink only onto the position of the sheet.

The $X_{start}$ and $X_{end}$ illustrated in FIG. 13 represent the main scanning positions of the carriage 3 when the position of reading by the sheet sensor 32 reaches the ends of the sheet. About the control of prohibiting discharging ink, it is conducted based on the main scanning position of the carriage 3 when the nozzles of the recording head 31 of colors of CMYK or the landing position of the ink discharged from the nozzles reach the end of the sheet.

Therefore, the CPU 101 stores the information illustrated in FIG. 13A and thereafter generates the information illustrated in FIG. 13B based on the positional relation between the position of reading by the sheet sensor 32 and the nozzles of the recording head 31 of the colors. The information illustrated in FIG. 13B is obtained by converting $X_{start}$ and $X_{end}$ illustrated in FIG. 13A based on the positional relations between the sheet sensor 32 and the nozzles of the recording head 31 of the colors of CMYK.

For example, $X_{start\text{-}C}$ and $X_{end\text{-}C}$ are obtained by adjusting the values of $X_{start}$ and $X_{end}$ based on the positional relation between the sheet sensor 32 and the nozzles of the recording head 31C. As a result, $X_{start\text{-}C}$ and $X_{end\text{-}C}$ represent the main scanning position of the carriage 3 when the nozzle of the recording head 31C has reached the end of the sheet, that is, the position determined based on the detection signal by the encoder sensor 33. The same respectively applies to $X_{start\text{-}M}$ and $X_{end\text{-}M}$, $X_{start\text{-}Y}$ and $X_{end\text{-}Y}$, $X_{start\text{-}K}$ and $X_{end\text{-}K}$, for the recording head 31M, the recording head 31Y, and the recording head 31K.

Thereafter, the CPU 101 confirms whether or not there is more image to be formed in the direction of the movement of the carriage 3 from this point forward (S1008). As a result of the confirmation, if there is no image left (S1008/NO), the processing completes at this point. If there is more image to be formed (S1008/YES), discharging of ink is prohibited (S1009) followed by completion of the processing since no sheet is present from this point forward in the main scanning position and the ink is discharged on the facing member 11 if the ink is discharged.

Figure 14:
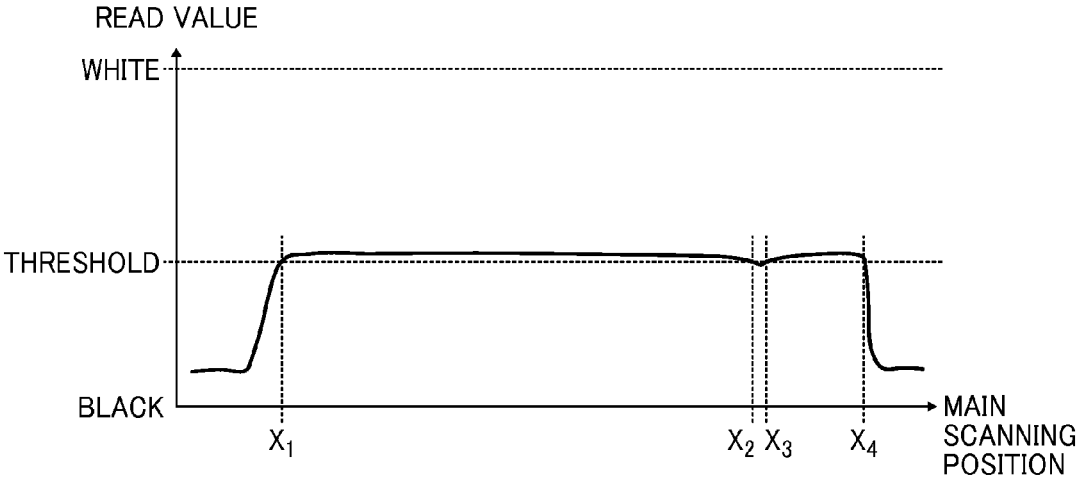
FIG. 14 is a diagram illustrating an example of the sheet detection result of tracing paper according to an embodiment of the present disclosure.

The prohibition of output of ink in the step of S1009 is conducted for each color based on the information illustrated in FIG. 13B. The operation completes by this processing when the result of reading by the sheet sensor 32 is normal. On the other hand, as described in the description of FIG. 9, a case is to be considered in which the difference between the result of reading by the sheet sensor 32 and the threshold is small. In this case, as in the interval from $X_2$ to $X_3$ illustrated in FIG. 14, the result of reading is possibly below the threshold in spite that the position of the carriage 3 has not reached the end of the sheet.

In such a case, the result of reading becomes less than the threshold in the step of S1005 (S1005/YES) and thereafter the result of reading surpasses the threshold again in a shorter interval of time (S1006/YES) than the predetermined interval (S1010). In this case, the CPU 101 does not proceed to the processing of the step of S1007 but returns to the step of S1005 to repeat determination whether or not the result of reading is less than the threshold. Thereafter, when reaching $X_4$ illustrated in FIG. 14, the determination in the step of S1006 is changed to YES, thereby to correctly detect the end of the sheet.

That is, the CPU 101 does not immediately determine that the carriage 3 has reached the end of the sheet when the result of reading by the sheet sensor 32 becomes less than the threshold but determines that the carriage 3 has reached the end of the sheet when the relation continues for the predetermined interval. Accordingly, this makes it possible to avoid detection errors in the case in which the difference between the result of reading and the threshold is small and the result of reading is just temporarily below the threshold due to variations of the results of reading.

As described above, the processing illustrated in FIG. 10 is executed only when the carriage 3 moves for the first time in the case of repeating processing of discharging ink by moving the carriage 3 in the main scanning direction while transferring the sheet in the sub-scanning direction. As a result, the information as illustrated in the FIG. 13B is generated.

In the image forming output from the point forward, the CPU 101 executes image forming output after determining the range of a sheet in the main scanning direction, that is, the range in which the ink is discharged for each color based on the information illustrated in FIG. 13B.

Figure 15:
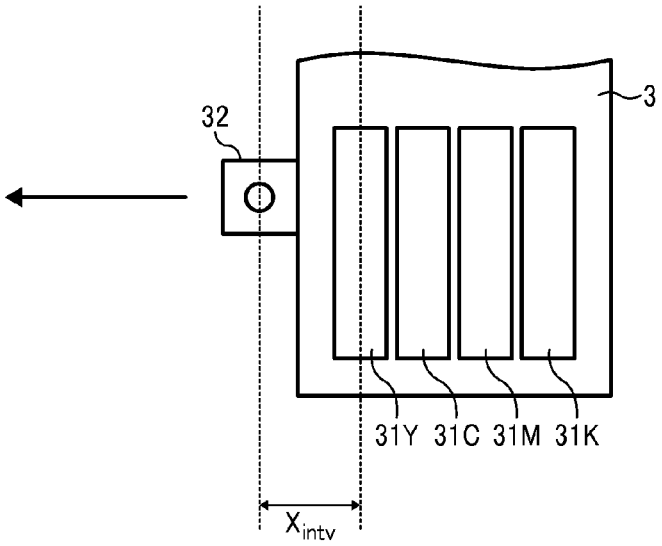
FIG. 15 is a diagram illustrating the relation between the configuration of a carriage and the determination threshold of the end of sheet according to an embodiment of the present disclosure.

Next, the predetermined interval determined in the step of S1006 is described. FIG. 15 is a diagram illustrating the configuration of the carriage 3 and the direction of movement when the carriage 3 is moving while discharging ink from the recording head 31. As described above, the sheet sensor 32 is arranged on the carriage 3 at a position on the top side in the direction of movement of the carriage 3. In addition, the recording head 31Y, the recording head 31C, the recording head 31M, and the recording head 31K of each color are arranged along the main scanning direction.

In addition, the position of the detection position of the sheet sensor 32 in the sub-scanning direction matches the position where the nozzles of the recording head 31 of each color are provided. Therefore, the position of a subject read by the sheet sensor 32 in the sub-scanning direction is the same as those of the nozzles of the recording head 31 of each color.

As illustrated in FIG. 15, the distance between the position of the nozzles of the recording head 31Y arranged at a position on the furthermost top side in the direction of the movement of the recording head 31Y, the recording head 31C, the recording head 31M, and the recording head 31K of each color and the detection position of the sheet sensor 32 is $X_{intv}$. Accordingly, there is a time taken for the carriage 3 to travel the interval of $X_{intv}$ before the nozzle of the recording head 31Y reaches the main scanning position corresponding to the detection signal subject to comparison determination with the threshold by the CPU 101.

As described in the description of FIG. 10, if "YES" is returned in the step of S1006 and the end position of the sheet is recorded, ink discharging is prohibited to positions ahead of the end position in the main scanning direction.

Since the recorded end position of the sheet is the main scanning position when "YES" is returned in the step of S1005, it is not possible to determine whether to prohibit ink discharging in the interval between the time when "YES" is returned in the step of S1005 and the step of S1006, that is, the predetermined interval.

To the contrary, the predetermined interval determined in the step of S1006 can be set not longer than the time margin the carriage 3 travels the interval $X_{intv}$ illustrated in FIG. 15. This condition is, in other words, equal to that the travel distance of the carriage 3 corresponding to the predetermined interval determined in the step of S1006 is not longer than $X_{intv}$.

In this case, after "YES" is returned in the step of S1005, the determination in the step of S1006 is complete before the nozzle of the recording head 31Y reaches the main scanning position. In addition, the position of a subject read by the sheet sensor 32 in the sub-scanning direction matches the position where the nozzles of the recording head 31 of each color are provided. Accordingly, it is possible to execute processing of output prohibition of the step of S1009.

The interval $X_{intv}$ illustrated in FIG. 15 is between the sheet sensor 32 and the nozzle of the recording head 31Y. However, the interval to be directly determined is the detection position of the sheet sensor 32 and the position where the ink discharged from the nozzle of the recording head 31 lands on the sheet.

The predetermined interval determined in the step of S1006 is defined by referring the travel distance of the carriage 3 as the reference. However, various values can be adopted depending on a real determination subject. For example, it is possible to make a determination if the number of times read signals less than a threshold are continuously acquired reaches and surpasses a predetermined number of times based on the sampling rate at which the CPU 101 acquires the signal of the sheet sensor 32. In addition, it is possible to make a determination when the interval in which the read signals are less than the threshold reaches or surpasses a predetermined interval based on the travel speed of the carriage 3.

Also, in the embodiment describe above, a wide breadth type image forming apparatus is taken as an example. In the case of an image forming apparatus for general sizes such as A4, it is possible to regulate the position of a sheet in some degree by a guide rail, etc. in the main scanning direction. Therefore, it is not so important to detect both ends of the sheet in the main scanning direction.

To the contrary, in a case of an image forming apparatus to form an image in a wide range while transferring a large-sized sheet such as A0, it is not easy to mechanically adjust the position of the sheet by a guide rail, etc.

Accordingly, the technologies of this embodiment are particularly suitable for a wide-breadth type image forming apparatus.

As described above, in this embodiment, whether or not it is the end of a sheet is not determined instantly when the read signal by an optical sensor falls below a threshold but when a relation of the read signal by an optical sensor being below the threshold continues for a predetermined interval. Therefore, a sheet having a low reflection rate is subject to detection and detection error can be prevented in a case in which the signal intensity of a read signal and a threshold is small.

In the embodiment described above, to improve reliability of a state in which the value according to the output signal of the sheet sensor 32 is below a threshold, that the state continues for a predetermined interval is set as the condition. However, this is just an example. The effect of the embodiment is that, in the case in which the value according to the output signal of the sheet sensor 32 is compared with a threshold to detect a sheet, a predetermined relation between the value and the threshold continuing for a predetermined interval is set as the condition. Therefore, this embodiment is applicable not only to the state in which a value according to the relation that the output signal is below a threshold but also any relation that can be a condition to detect a sheet.

In addition, the condition of continuation for a predetermined interval is to determine continuation for the predetermined interval in the movement of a carriage. That is, in this embodiment, the output signal of the sheet sensor 32 is acquired while moving the carriage 3. Therefore, the predetermined interval is to set a predetermined or longer range as the travel distance of the carriage.

In addition, in the embodiment describe above, as illustrated in FIG. 9, tracing paper is described as an example of a sheet having a weak signal intensity as the result of reading. However, this is just an example. The same can be applied to any case in which a subject has a reflection rate slightly different from that of the facing member 11. Examples thereof include print paper for sign graphics, circuit substrates, and operation panels for use in vehicles.

Second Embodiment

In the first embodiment, detection of both ends of paper in the main scanning direction is described as an example. In the second embodiment, in a case in which an image is output onto format paper of ledger sheets on which images such as lines and pictorial figures are drawn beforehand, an example of prohibiting discharging ink on the images formed in advance is described.

Figure 16:
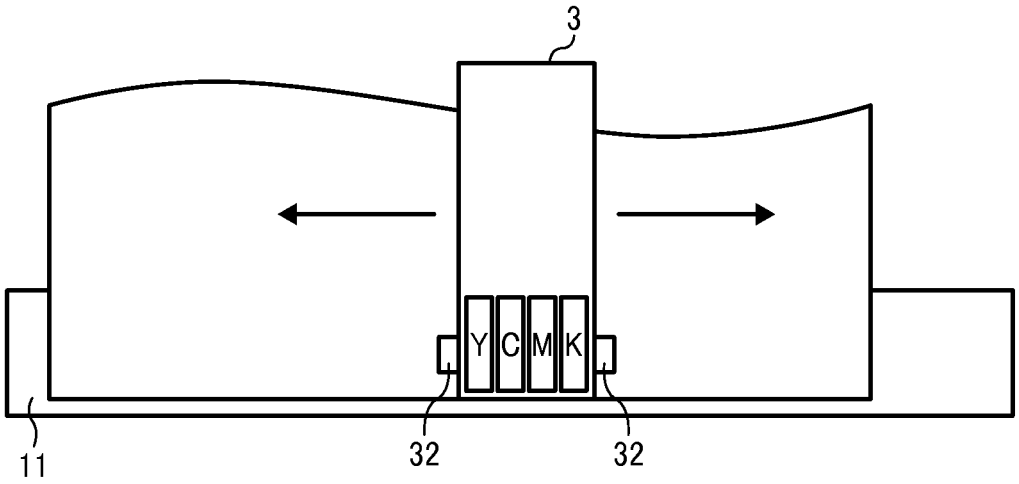
FIG. 16 is a diagram illustrating the state of movement of the carriage when a recording head discharges ink according to another embodiment of the present disclosure.

The entire configuration of the image forming apparatus 1 of the second embodiment is almost the same as that of the first embodiment so that detailed descriptions thereof are omitted. FIG. 16 is a diagram illustrating the state of the movement of the carriage 3 in the image forming apparatus 1 of the second embodiment. As illustrated in FIG. 16, in the recording device 1*a* according to this embodiment, the carriage 3 discharges ink while moving forward and backward.

Therefore, the sheet sensors 32 are provided at both ends of the carriage 3 in the main scanning direction. Due to this, as described in the first embodiment, the CPU 101 is able to acquire the detection signals of the sheet sensors 32 before the nozzles of the recording head 31 reach each position in the main scanning direction.

In addition, the interval between the detection position of the sheet sensor 32 and the nozzles of the recording head 31 on the side on which the sheet sensor 32 is provided is the same in the two sheet sensors 32.

Figure 17:
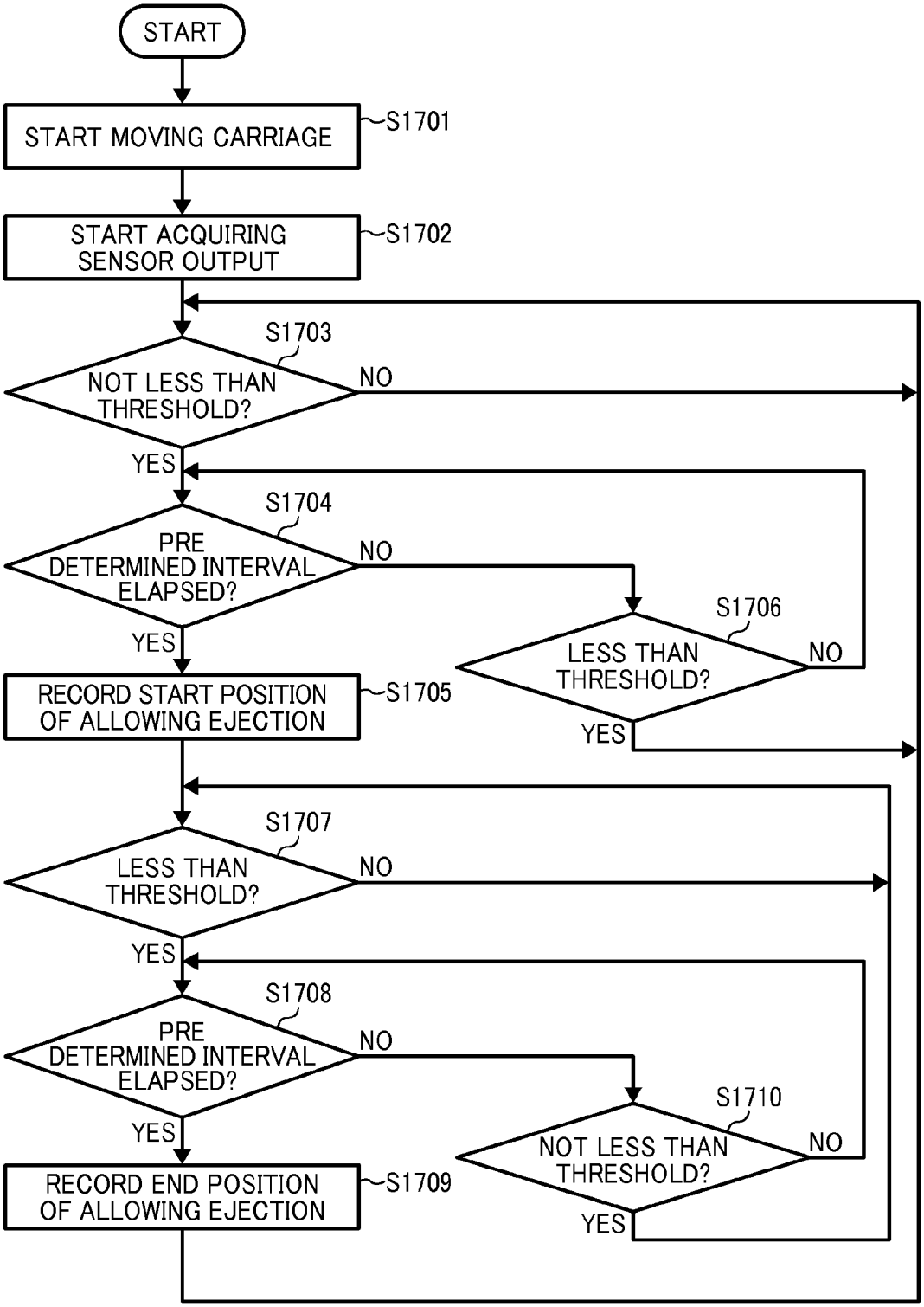
FIG. 17 is a flow chart illustrating operations of sheet detection according to another embodiment of the present disclosure.

FIG. 17 is a flow chart illustrating operations of sheet detection according to the second embodiment. In the steps of S1701 and S1702, the same processing is executed as in FIG. 10. The detection signal of the sheet sensor 32 acquired by the CPU 101 means the detection signal of the sheet sensor 32 provided at a position on the top side in the direction of the movement of the carriage 3. Therefore, the CPU 101 executes comparison processing (S1703) between the detection signal of the sheet sensor 32 and a threshold in the same manner as in the first embodiment.

When the detection signal of the sheet sensor 32 is not less than the threshold (S1703/YES), the CPU 101 determines whether or not this relation continues for a predetermined interval (S1704). When the detection signal is less than the threshold (S1706/YES) before the predetermined interval elapses (S1704/NO), the CPU 101 repeats processing from the step of S1703.

On the other hand, when the predetermined interval has passed (S1704/YES) without the detection signal falling below the threshold (S1706/NO), the CPU 101 determines that it is in the range in which ink discharging is allowed and records the main scanning position of the carriage 3 on the timing of "YES" in the step of S1703 as the start point from which ink discharging is allowed (S1705).

The CPU 101 repeats executing the comparison processing of the results of reading by the sheet sensor 32 with the threshold after recording the start position from which ink discharging is allowed. When the detection signal of the sheet sensor 32 is less than the threshold (S1707/YES), the CPU 101 determines whether or not this relation continues for a predetermined interval (S1708). When the detection signal is not less than the threshold (S1710/YES) before the predetermined interval elapses (S1708/NO), the CPU 101 repeats processing from the step of S1707.

On the other hand, when the predetermined interval has passed (S1708/YES) without the detection signal surpassing the threshold (S1710/NO), the CPU 101 determines that the range in which ink discharging is allowed is over and records the main scanning position of the carriage 3 on the timing of "YES" in the step of S1707 as the end point of allowing ink discharging (S1709).

Figures 18, 19:
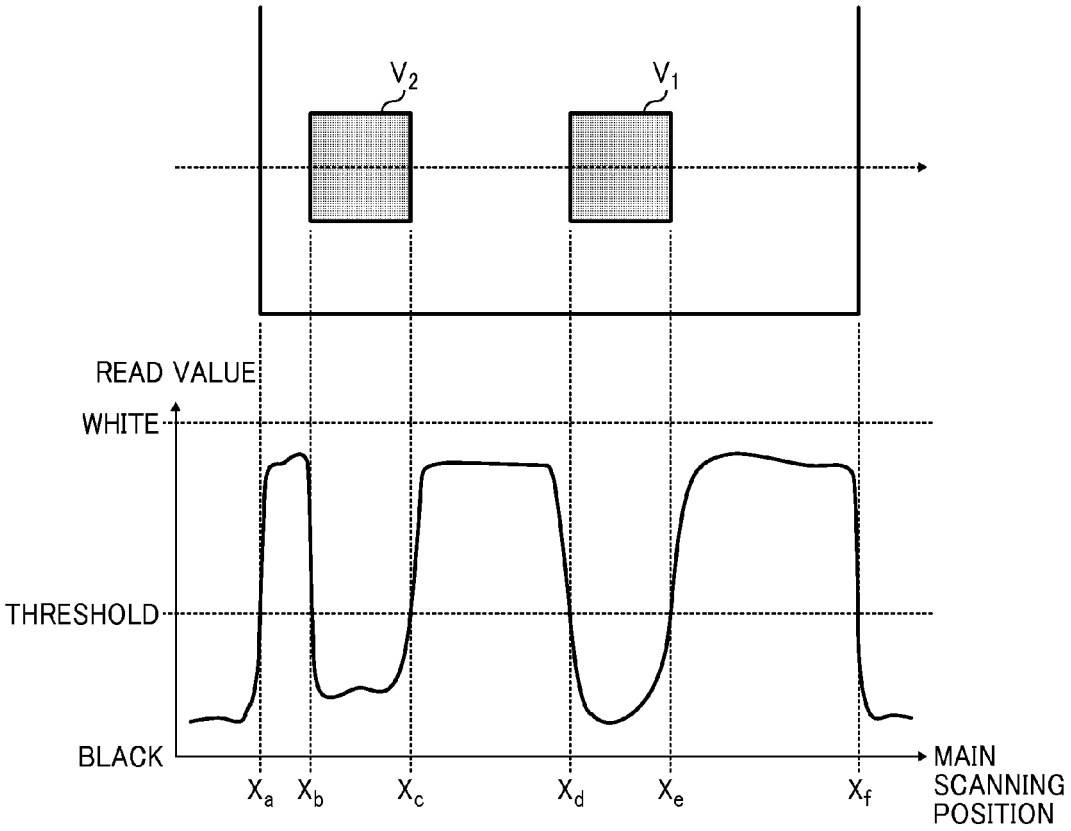
FIG. 18 is a diagram illustrating an example of the sheet detection result of paper on which an image is printed in advance according to an embodiment of the present disclosure.
FIG. 19 is a diagram illustrating information created in the operation of sheet detection according to an embodiment of the present disclosure.

FIG. 18 is graphs illustrating the results of reading according to the main scanning position while correlating with the surface of a sheet. In FIG. 18, image forming output is executed for a sheet on which an image $V_1$ and an image $V_2$ are drawn in advance. The carriage 3 scans in the direction indicated by the arrow in FIG. 18.

As illustrated in FIG. 18, $X_a$ as one end of the sheet is recorded in the step of S1705 and $X_f$ as the other end is recorded in the step of S1709. In addition, in the detection of a sheet in the second embodiment, each of the main scanning positions of the images is recorded in order to exclude the portion corresponding to the image $V_1$ and the image $V_2$ from the image forming.

Specifically, by recording the position of $X_b$ in the step of S1709, the range from Xa to Xb is recorded as image forming output allowable, that is, ink dischargeable range as the ink dischargeable range 1 illustrated in FIG. 19. In addition, by recording not only $X_c$ in the step of S1705 but also $X_d$ in the step of S1709, this range is recorded as an ink dischargeable range 2.

In addition, by recording not only $X_e$ in the step of S1705 but also $X_f$ in the step of S1709, this range is recorded as an ink dischargeable range 3.

The CPU 101 repeats the steps of from S1703 to S1710 illustrated in FIG. 17 as long as ink is discharged for image forming output. Thereafter, prior to reaching of the nozzle of the recording head 31, the information of dischargeable range is generated as illustrated in FIG. 19 and ink discharging is controlled only for the dischargeable range. That is, for outside the dischargeable range, mask control is conducted in order to prevent the ink from discharging.

This control makes it possible to avoid overwriting of the ink on paper on which some sort of images like the images $V_1$ and $V_2$ which are drawn in advance in the image forming output. The information illustrated in FIG. 19 is the same as that illustrated in FIG. 13A. In the control in reality, the information of the dischargable range for each color of YMCK is generated as illustrated in FIG. 13B based on the information illustrated in FIG. 19.

In the example illustrated in FIG. 19, the dischargeable range is recorded as the information and ink is discharged only for the dischargeable range. It is also possible to conduct control by recording the range in which images such as the images $V_1$ and $V_2$ are drawn in advance as the non-dischargeable range and prohibiting ink discharging for the range.

According to the present disclosure, detection processing of a recording medium can be conducted with high accuracy by reading the surface of the recording medium.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

According to the present disclosure, an operation control based on operation noises of an apparatus is provided to reduce the level of discomfort caused by the operation noise and improve utility of the device while securing safety of the entire of the apparatus.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC) and conventional circuit components arranged to perform the recited functions.

The present invention can be implemented in any convenient form, for example using dedicated hardware, or a mixture of dedicated hardware and software. The present invention may be implemented as computer software implemented by one or more networked processing apparatuses. The network can comprise any conventional terrestrial or wireless communications network, such as the Internet. The processing apparatuses can compromise any suitably programmed apparatuses such as a general purpose computer, personal digital assistant, mobile telephone (such as a WAP or 3G-compliant phone) and so on. Since the present invention can be implemented as software, each and every aspect of the present invention thus encompasses computer software implementable on a programmable device. The computer software can be provided to the programmable device using any storage medium for storing processor readable code such as a floppy disk, hard disk, CD ROM, magnetic tape device or solid state memory device.

The hardware platform includes any desired kind of hardware resources including, for example, a central processing unit (CPU), a random access memory (RAM), and a hard disk drive (HDD). The CPU may be implemented by any desired kind of any desired number of processor. The RAM may be implemented by any desired kind of volatile or non-volatile memory. The HDD may be implemented by any desired kind of non-volatile memory capable of storing a large amount of data. The hardware resources may additionally include an input device, an output device, or a network device, depending on the type of the apparatus. Alternatively, the HDD may be provided outside of the apparatus as long as the HDD is accessible. In this example, the CPU, such as a cache memory of the CPU, and the RAM may function as a physical memory or a primary memory of the apparatus, while the HDD may function as a secondary memory of the apparatus.

What is claimed is:

1. An image forming apparatus comprising:

a recording head to discharge ink to a recording medium to form an image thereon;

an optical sensor to output a signal in response to intensity of reflection of light emitted to a direction of discharging the ink;

a carriage that carries the recording head and the optical sensor; and a control unit to detect a position of the recording medium within a range of movement of the carriage based on the signal output by the optical sensor and control the recording head to discharge the ink only onto the position of the recording medium, wherein the control unit acquires a value according to the signal output by the optical sensor in response to the movement of the carriage and detects the position of the recording medium within the range of movement of the carriage when a predetermined relation between the value and a threshold continues at least for a predetermined interval in the movement of the carriage.

2. The image forming apparatus according to claim 1, wherein the control unit determines that when the value is not less than the threshold, a reading position of the optical sensor on a timing when the value reaches or surpasses the threshold is a start position of the recording medium in a direction of the movement of the carriage and when the predetermined relation is that the value is below the threshold and continues at least for the predetermined interval in the movement of the carriage, the reading position of the optical sensor on a timing when the value falls below the threshold is an end position of the recording medium in the direction of the movement of the carriage.

3. The image forming apparatus according to claim 2, wherein the control unit conducts image forming output by repeating an operation of discharging the ink from the recording head to the recording medium transferred in a direction perpendicular to the direction of the movement of the carriage while moving the carriage multiple times and executes detection of the position of the recording medium based on the signal only for a first time of the movement of the carriage of the multiple times.

4. The image forming apparatus according to claim 1, wherein the control unit conducts image forming output by repeating an operation of discharging the ink from the recording head to the recording medium transferred in a direction perpendicular to the direction of the movement of the carriage while moving the carriage multiple times, executes detection of the position of the recording medium based on the signal each time of the movement of the carriage of the multiple times, and controls the recording head to discharge the ink only on the position of the recording medium.

5. The image forming apparatus according to claim 1, wherein the optical sensor is disposed on the carriage at a position downstream of nozzles from which the recording head discharges the ink in the direction of the movement of the carriage and the predetermined interval is not longer than a distance between a detection position by the optical sensor and a position where the ink discharged from the nozzles lands.

6. A control method of an image forming apparatus comprising:

outputting an image on a recording medium by discharging ink from a recording head carried by a carriage while moving the carriage;

acquiring a value in response to a signal output by an optical sensor carried by the carriage in response to intensity of reflection of light emitted to a direction of discharging the ink according to movement of the carriage;

detecting a position of the recording medium within a range of the movement of the carriage when a predetermined relation between the value and a threshold continues at least for a predetermined interval in the movement of the carriage; and controlling the recording head to discharge the ink only onto the position of the recording medium.

7. A non-transitory recording medium storing a plurality of instructions which, when executed by one or more processors, cause the processors to perform a control method of an image forming apparatus, comprising:

outputting an image on a recording medium by discharging ink from a recording head carried by a carriage while moving the carriage;

acquiring a value in response to a signal output by an optical sensor carried by the carriage in response to intensity of reflection of light emitted to a direction of ink discharging according to movement of the carriage;

detecting a position of the recording medium in a range of the movement of the carriage when a predetermined relation between the value and a threshold continues at least for a predetermined section in the movement of the carriage; and controlling the recording head to discharge the ink only onto the position of the recording medium.

* * * * *